US006511950B1

(12) United States Patent
Jenevein

(10) Patent No.: US 6,511,950 B1
(45) Date of Patent: Jan. 28, 2003

(54) CLEANING COMPOSITION COMPRISING A SALT, CHELANT, AND POLYVINYL ALCOHOL

(76) Inventor: Earl Jenevein, P.O. Box 1000, Robert, LA (US) 70455

( * ) Notice: Subject to any disclaimer, the term of this patent is extended or adjusted under 35 U.S.C. 154(b) by 0 days.

(21) Appl. No.: 10/208,232

(22) Filed: Jul. 30, 2002

(51) Int. Cl.[7] ..... C11D 1/62; C11D 3/30

(52) U.S. Cl. ..... 510/189; 510/238; 510/241; 510/243; 510/244; 510/245; 510/254; 510/362; 510/365; 510/480; 510/504; 510/382; 510/384; 510/391

(58) Field of Search ..... 510/189, 238, 510/241, 243, 244, 245, 254, 362, 365, 480, 504, 382, 384, 391

(56) References Cited

U.S. PATENT DOCUMENTS 5,470,492 A 11/1995 Childs et al.
5,476,599 A 12/1995 Rusche et al.
5,503,756 A * 4/1996 Corona, III et al. ..... 510/519
5,578,234 A 11/1996 Corona, III et al.
5,929,026 A 7/1999 Childs et al.

* cited by examiner

*Primary Examiner*—Charles Boyer
(74) *Attorney, Agent, or Firm*—Keaty Professional Law Corporation

(57) ABSTRACT

A cleaning composition for treating and removing stains from a non-porous surface has one or more salts, such as quaternary ammonium salts, sulfates and chlorides, a chelator and a dispersant, dissolved in an aqueous solution of alcohol. Optional active ingredients include methyl cellosolve and ammonia. The quaternary ammonium salts are myristyltrimethylammonium bromide and benzethonium chloride, the chelator is tetrasodium salt ethylenediamine of tetraacetic acid, and the dispersant is polyvinyl alcohol. The cleaning composition is incorporated into a product, which has a non-woven polyester carrier impregnated with the cleaning composition.

20 Claims, No Drawings

CLEANING COMPOSITION COMPRISING A SALT, CHELANT, AND POLYVINYL ALCOHOL

BACKGROUND OF THE INVENTION

The present invention relates to a cleaning composition and, more particularly, to a composition for removal of stains and greasy substances from non-porous surfaces. Even more particularly, the present invention relates to a cleaning composition and a product prepared by attaching the cleaning composition to a substrate.

The chemical industry has created a multitude of cleaning agents for use in removal or dissolving various types of stains, be the stains water-based or oil-based. There are special stain removal products for attacking paint stains, food stains, oil and grease stains, etc. They are usually sold in a liquid form. A user either sprays the cleaning agent on the stained surface or pours a small amount of the cleaning compound on a piece of cloth and rubs the stained surface to dissolve and remove the stain.

There also exists a special line of stain removal products for cleaning automobiles, glass surfaces, stainless steel surfaces, kitchen countertops and the like. Similarly to the general cleaners, the special duty cleaners may be sold in bottles ready for spraying or in a liquid form for applying to the surface with a piece of cloth.

One of the most arduous cleaning task is removal of dirt and grime from automobile front fenders. Every car owner is well familiar with the difficulty, with which insect remains, tar, "traffic film," and other similar stains can be removed from the car exterior. Commercially available products require a lot of "elbow grease" to get such stains out.

The present invention contemplates provision of a "universal" cleaning composition and a product prepared by attaching the cleaning composition to a substrate to facilitate fast cleaning of solid non-porous surfaces of a variety of stains, such as grease, crayon, tar, and others.

SUMMARY OF THE INVENTION

It is, therefore, an object of the present invention to provide a cleaning composition for use on non-porous surfaces for removal of a variety of stains.

It is another object of the present invention to provide a product, wherein the cleaning composition of the present invention is attached to a substrate.

It is a further object of the present invention to provide a cleaning composition that can be used for removal of protein-based, oil-based, water-based and other types of stains.

These and other objects of the invention are achieved through a provision of a cleaning composition, which comprises one or more quaternary ammonium salts, sulfates, chlorides or bromides. The cleaning composition of the instant invention further comprises a chelator, such as for instance edetate sodium and more specifically, tetrasodium salt (tetrasodium edetate) of ethylenediamine tetraacetic acid (EDTA). The preferred embodiment further comprises a dispersant, such as for instance polyvinyl alcohol.

Optional cellosolve, for instance methyl cellosolve and ammonia (in the form of ammonium chloride) may be added to enhance the cleaning properties of particularly resistant stains. The active ingredients are mixed with a solvent, for instance alcohol, such as ethanol. The amount of methyl cellosolve is added in the amount of between 0.4% and about 4% by volume; ammonia was added in the amount of between 0.1% and 5% by volume.

A tested preferred embodiment of the present invention comprises between about 0.4 to 4.2% by volume of each myristyltrimethylammonium bromide, benzethonium chloride and tetrasodium salt ethylenediamine of tetraacetic acid (EDTA) and between about 0.4 to about 1.0% of polyvinyl alcohol. The active ingredients are mixed with 35% aqueous solution of ethanol to make up 100% by volume.

A product of the present invention is made by impregnating a flexible porous substrate with a pre-determined quantity of the solution to render the substrate wet. The substrate may be a non-woven polyester fabric.

DETAILED DESCRIPTION OF THE PREFERRED EMBODIMENT

The present invention concerns with a cleaning composition and a product prepared using the cleaning composition, where a substrate is impregnated with the cleaning composition. The cleaning composition contains a solvent, which in the preferred embodiment is an alcohol dissolved in water, and more specifically, ethanol.

The cleaning composition contains sulfate salts, chlorides or bromides as the active ingredients. Suitable sulfates are selected from the group consisting of methyl bis (hydrogenated tallow amidoethyl)-2-hydroxyethyl ammonium methyl sulfate, methyl bis(tallow amidoethyl)-2-hydroxyethyl ammonium methyl sulfate, methyl bis(soya amidoethyl)-2-hydroxyethyl ammonium methyl sulfate, methyl bis(canola amidoethyl)-2-hydroxyethyl ammonium methyl sulfate, methyl bis(tallowamido ethyl)-2-tallow imidazolinium methyl sulfate.

The halogens are selected from the group consisting of myristyltrimethylammonium bromide, benzethonium chloride, PEG-6 lauramide, stearalkonium chloride, cocoamidopropylamine oxide, cetrimonium chloride, cetamine oxide, lauramine oxide, dipalmitoylethyl hydroxyethymmonium methusulfate, elalkonium chloride, lauramine oxide, myrystamine oxide, stearamin oxide, cocamidopropyl betaine, cetyl dimethyl betaine, hydrogenated cocamidopropyl betaine, laurylamidopropyl betaine, polyglyceryl-10 decaoleate propylene, propylene glycol/dicaprylate/dicaprate, caprylic/capric triglyceride, lauramide DEA, cocamide DEA, cocamide MEA, lauramide MEA, cocamide MIPA, coco diethanolamine, butoxy ethyl stearate, distearyl phthalic acide amide, di)hydrogenated) tallow phthalic acid, sodium stearyl phthalamate.

The cleaning composition of the instant invention further comprises a chelator, such as for instance edetate sodium and more specifically, tetrasodium salt (tetrasodium edetate) of ethylenediamine tetraacetic acid (EDTA). The preferred embodiment further comprises a dispersant, such as for instance polyvinyl alcohol.

The cleaning composition was tested using quaternary ammonium salts, more specifically myristyltrimethylammonium bromide and benzethonium chloride. The following description of the preferred embodiment refers to these salts, although it will be apparent to those skilled in the art that other sulfates, chlorides and bromides may used.

Myristyltrimethylammonium bromide, or N,N,N-Trimethyl-1-tetradecanamium bromide; trimethyltetradecylammonium bromide; tetradonium bromide is a cationic germicidal detergent, often used in disinfectant and deodorant compositions.

Benzethonium chloride, or N,N-Dimethyl-N-[2-[2-[4-(1,1,3,3-tetramethylbutyl)phenoxy]ethoxy]ethyl]benzenemethanaminium chloride; benzyldimethyl[2-[2-(p-1,1,3,3-tetramethylbutylphenoxy)ethoxy]ethyl]ammonium chloride is very soluble in water, producing a foamy, soapy solution. It is soluble in alcohol, acetone and chloroform. It is the compound's solubility in water and alcohol that became an important factor in selecting this salt for the cleaning composition of the present invention.

EDTA, which is used as a chelating agent, is N,N-1,2-Ethanediylbin[N-(carboxymethyl)glycene] tetrasodium salt; (ethylenedinitrilo)retroacidic acid tetrasodim salt. It is usually sold as a powder, which is readily soluble in water.

Polyvinyl alcohol that is used in the most preferred embodiment is ethanol homopolymer. Some of the polyvinyl alcohols are soluble in hot and cold water; and some require a mixture of alcohol and water for solubility. Since the cleaning composition provides for the use of an aqueous solution of alcohol as a solvent, polyvinyl alcohol is fully soluble at the pre-determined concentration.

The cleaning composition of the present invention may also contain methyl cellosolve and ammonia, depending on the type of stain the composition is intended to remove. It is envisioned that the cleaning composition that has optional methyl cellosolve and ammonia can be used for cleaning of car surface and similar objects.

The basic cleaning composition comprises myristyltrimethylammonium bromide, benzethonium chloride, tetrasodium salt ethylenediamine tetraacetic acid (EDTA) and polyvinyl alcohol dissolved in an aqueous solution of alcohol, such as ethanol. The preferred embodiment comprises between about 0.4 to 4.2% by volume of each myristyltrimethylammonium bromide, benzethonium chloride and tetrasodium salt ethylenediamine of tetraacetic acid (EDTA) and between about 0.4 to about 1.0% of polyvinyl alcohol. The active ingredients are mixed with 35% aqueous solution of ethanol to make up 100% by volume.

To prepare 1 liter of the cleaning composition of the present invention, polyvinyl alcohol was mixed with warm (50–60 degrees Celsius) water. Then, myristyltrimethylammonium bromide, benzethonium chloride and tetrasodium salt ethylenediamine tetraacetic acid (EDTA) were added and mixed with ethanol dissolved in water to achieve a desired concentration of the four active ingredients in ethanol and water.

When cellosolve (in the amount of between about 0.4% and 4% by volume) and ammonia (aqueous solution of ammonium hydroxide —at 66.6% ammonia concentration) was added in the amount of between about 0.1% and about 5% by volume.

During tests, the polyvinyl alcohol concentration was between about 0.4% to about 1.0%. Higher concentration of the polyvinyl alcohol, above 1% caused the polyvinyl alcohol to come out of the solution. Therefore, it was decided that the preferred embodiment should contain 1% or less of polyvinyl alcohol.

When the optional methyl cellosolve and ammonia were added, celloslve was tested at 0.4, 1.0, 2.0, 3.0 and 4.0% in the ethanol solution. Ammonia (in the form of 56% concentration in concentrated ammonium hydroxide) was added to a concentration of 1.5%. During tests, it was determined that polyvinyl alcohol was insoluble at the 4% level. Therefore, it is envisioned that the cleaning composition should have less than 4% concentration.

The cleaning composition of the present invention was tested at various concentrations, from 0.05% of the first four main active ingredients to 4.0% concentration of the main active ingredients. The cleaning composition was also tested using the optional methyl cellosolve and ammonia.

The cleaning composition was tested on such diverse stains as black paste shoe polish, black crayon, black rubber, liquid sole and heel shoe stain, black scuff shoe coating, black felt tip marker. Even at the lowest concentration of the cleaning composition, the marks were easily removed for all of the stains except for the black paste shoe polish.

However, when the cleaning composition was applied to the black paste shoe polish in a thin layer and allowed to dry for a pre-determined period of time (which was 4 hours for that particular test), and then rubbed off with a paper towel, the stain was almost entirely removed (the amount of paste remaining was visually approximated as follows:

| Mixture | Concentration % | Effect: Polish remaining % |
|---|---|---|
| Four main ingredients | 0.05 | 100 |
| Four main ingredients | 0.10 | 98 |
| Four main ingredients | 0.25 | 96 |
| Four main ingredients | 0.40 | 90 |
| Four main ingredients | 1.00 | 50 |
| Four main ingredients + methyl cellosolve + 1.5% ammonia | 0.40 | 50 |
| Four main ingredients + methyl cellosolve + 1.5% ammonia | 1.00 | 55 |
| Four main ingredients + methyl cellosolve + 1.5% ammonia | 2.00 | 55 |
| Four main ingredients + methyl cellosolve + 1.5% ammonia | 3.00 | 55 |

Based on the tests, it was determined that the concentration of the four main ingredients should be between about 0.25% and 3%, and preferably between about 0.4% and 3%. It is envisioned that stronger concentrations of the solution may be used for resistant stains, such as black shoe polish, and weaker solutions can be used for removing light stains, such as food and protein-based stains.

To prepare a product of the present invention, a flexible porous substrate was impregnated with the cleaning composition of the present invention. The substrate can be made of polyester non-woven fabric having a thickness from about 0.17 mm to about 0.22 mm. Such fabric is readily available from a variety of manufacturers.

Depending on the concentration and the active ingredients of the cleaning solution, the product may be prepared for removing tough stains, such black paste shoe polish or for lighter stains, such as food and protein-based stains.

Depending on the desired resultant product, the substrate, or carrier may be selected from different size fabric pieces, from 2"×2" ("pocket" size) to 12"×12" (industrial applications, car cleaning, etc.) Of course, the size and shape of the substrate can differ even more. It is envisioned that the product may be packaged individually or in any desired number per package. A sealed package will retain the solution in a liquid form, with the carrier remaining wet for immediate application, if desired.

The cleaning composition may also be sold in a liquid form ready for a user to be applied to a selected substrate, be it a paper towel, a rag, a sponge or the like.

Many changes and modifications may be made in the composition of the present invention without departing from the spirit thereof. I, therefore, pray that my rights to the present invention be limited only by the scope of the appended claims.

I claim:

1. A cleaning composition, comprising:

between about 0.4% and 4.2% by volume of one or more sulfate salts, chlorides or bromides selected from the group consisting of methyl bis(hydrogenated tallow amidoethyl)-2-hydroxyethyl ammmonium methyl sulfate, methyl bis(tallowamido ethyl)-2-hydroxyethyl ammonium methyl sulfate, methyl bis(soya amidoethyl)-2-hydroxyethyl ammonium methyl sulfate, methyl bis(canola amidoethyl)-2-hydroxyethyl ammonium methyl sulfate, methyl bis(tallowamido ethyl)-2-tallow imidazolinium methyl sulfate, myristyltrimethylammonium bromide, benzethonium chloride, stearalkonium chloride, and cetrimonium chloride;

between about 0.4% and 4.2% by volume of a chelator; and between about 0.4% and 1% by volume of a dispersant, dissolved in a, 35% aqueous solution of alcohol, said dispersant comprising a polyvinyl alcohol.

2. The cleaning composition of claim 1, wherein said one or more salts comprise myristyltrimethylammonium bromide and benzethonium chloride.

3. The cleaning composition of claim 1, wherein said chelator comprises edetate sodium.

4. The cleaning composition of claim 3, wherein said edetate sodium is tetrasodium salt of ethylenediamine tetraacetic acid.

5. The cleaning composition of claim 1, comprising between about 0.4% and 4.2% by volume of each myristyltrimethylammonium bromide, benzethonium chloride and tetrasodium salt of ethylenediamine tetraacetic acid, and between about 0.4 to about 1.0% by volume of polyvinyl alcohol, dissolved in a 35% aqueous solution of ethanol.

6. The cleaning composition of claim 1, further comprising a pre-determined amount of methyl cellosolve and ammonia.

7. The cleaning composition of claim 6, wherein said composition comprises between about 0.4% and 4% by volume of methyl cellosolve and between about 0.1 and 5% by volume of ammonia.

8. A cleaning composition, comprising:

between about 0.4% and 4.2% by volume each myristyltrimethylammonium bromide, benzethonium chloride and tetrasodium salt of ethylenediamine tetraacetic acid, and between about 0.4 to about 1.0% by volume of polyvinyl alcohol, dissolved in a 35% aqueous solution of ethanol.

9. The cleaning composition of claim 8, wherein said composition further comprises between about 0.4% and 4% by volume of methyl cellosolve and between about 0.1 and 5% by volume of ammonia.

10. A method of treating stains on a non-porous surface, the method comprising the steps of:

applying to the stained surface a pre-determined amount of the cleaning composition of claim 1.

11. The method of claim 10, wherein said salts comprise myristyltrimethylammonium bromide and benzethonium chloride, said chelator is tetrasodium salt of ethylenediamine tetraacetic acid, and said dispersant is polyvinyl alcohol.

12. The method of claim 10, wherein said aqueous solution of alcohol comprises ethanol.

13. The method of claim 12, wherein said mixture further comprises a pre-determined amount of methyl cellosolve and ammonium hydroxide.

14. The method of claim 11, wherein said mixture comprises between about 4% and 4.2% by volume each myristyltrimethylammonium bromide, benzethonium chloride and tetrasodium salt of ethylenediamine tetraacetic acid, and between about 0.4 to about 1.0% by volume of polyvinyl alcohol, dissolved in 35% aqueous solution of ethanol.

15. The method of claim 13, wherein said mixture comprises between about 0.4% and 4% by volume of methyl cellosolve and between about 0.1 and 5% by volume of ammonia.

16. The method of claim 10, further comprising the step of allowing said mixture to dry and then rubbing said surface to remove the dried mixture.

17. A device for removing stains from a non-porous surface, comprising:

a flexible porous carrier impregnated with the cleaning composition of claim 1.

18. The device of claim 17, wherein said carrier is made from a non-woven polyester fabric.

19. The device of claim 17, wherein said cleaning composition comprises between about 0.4% and 4.2% by volume each myristyltrimethylammonium bromide, benzethonium chloride and tetrasodium salt of ethylenediamine tetraacetic acid, and between about 0.4 to about 1.0% by volume of polyvinyl alcohol, dissolved in 35% aqueous solution of ethanol.

20. The device of claim 19, wherein said cleaning composition further comprises between about 0.4% and 4% by volume of methyl cellosolve and between about 0.1 and 5% by volume of ammonium hydroxide.

* * * * *